United States Patent [19]

Sato

[11] 3,997,124

[45] Dec. 14, 1976

[54] CORE HOLDING DEVICE FOR LABEL STRIP

[75] Inventor: Yo Sato, Tokyo, Japan

[73] Assignee: Kabushiki Kaisha Sato Kenkyusho, Tokyo, Japan

[22] Filed: Apr. 12, 1976

[21] Appl. No.: 675,825

[30] Foreign Application Priority Data

Apr. 12, 1975 Japan ..... 50-048862[U]

[52] U.S. Cl. ..... 242/68

[51] Int. Cl.[2] ..... B65H 17/02

[58] Field of Search ..... 242/68.5, 55, 68, 68.1, 242/68.3, 68.6; 156/384, 541, 584

[56] References Cited

UNITED STATES PATENTS

| | | | |
|---|---|---|---|
| 2,788,944 | 4/1957 | Krueger | 242/68 X |
| 2,904,277 | 9/1959 | Underwood | 242/68.5 |
| 3,860,191 | 1/1975 | Geri | 242/68.5 |
| R27,889 | 1/1974 | Sato | 156/384 |

*Primary Examiner*—Edward J. McCarthy
*Attorney, Agent, or Firm*—Ostrolenk, Faber, Gerb & Soffen

[57] ABSTRACT

A core holding device for rotatably holding a core on which a label strip, having separable labels to be printed and applied, is wound. The holding device includes a core holding member equipped with a plurality of flexible, resilient fingers for removably, resiliently holding the core so that the core and holding member rotate together. There is a mounting bracket with a circular recess for removably and rotationally mounting the core holding member. Spaced from, but attached to, the mounting bracket is a juxtaposed core looseness preventing bracket. This bracket is pivotable between a first position to provide easy access into the space between the brackets for mounting and removing the core and a second position which prevents the label strip from falling away from the core. The facing contacting surfaces of the core holding member and the mounting bracket act as two brake surfaces which contact frictionally for imparting a predetermined braking force to the rotation of the core holding member so that the label strip may be prevented from getting slack while it is being fed.

8 Claims, 4 Drawing Figures

FIG. I
1
2
3
4
11
12
14
III
III

CORE HOLDING DEVICE FOR LABEL STRIP

BACKGROUND OF THE INVENTION

1. Field of the Invention

The present invention relates to a label roll core holding device for use in a label printing and applying apparatus.

2. Description of the Prior Art

In one conventional holding device of this type, a saw-toothed, rough surface is formed on the inner periphery of a circular recess. The recess is formed in the inner side wall of a mounting bracket. This bracket is spaced from a looseness preventing bracket for preventing a label strip roll from falling or unwinding sideways off its core. Within the circular recess is rotatably fitted a core holding member, which has control pawls on its outer periphery that engage with the saw-toothed inner periphery of the circular recess. At one side of the holding member are a set of flexible fingers which removably engage with the core. Thus, every time the label strip is unwound from the core, proper tension is continuously exerted upon the label strip through the engagement of the control pawls of the core holding member with the saw-toothed inner periphery of the recess.

An advantage of the conventional core holding device having the above construction is that the core for the label strip can be removably held in position. Also, because the label strip can be unwound under predetermined tension at all times, another advantage is that there is no slackness in the label strip.

The conventional core holding device has a complicated construction and requires excessively precise techniques for the manufacture of its core holding member. This leads to high production cost for the core holding member which, in turn, raises the cost of the whole label printing and applying apparatus.

SUMMARY OF THE INVENTION

It is, therefore, a major object of the invention to provide an improved core holding device for a label strip.

Another object of the present invention is to provide an improved core holding device of the above type, in which the core is turned by drawing upon the label strip against a predetermined braking force so that the label strip does not become slack while it is being fed.

Still another object is to provide an improved core holding device of the above type, in which attachment and removal of the core can be accomplished quite simply.

A further object is to provide an improved core holding device of the above type, in which the label strip rolled on the core is prevented during its use from falling off the side of the core.

A further object is to provide an improved core holding device of the above type, which has a simplified construction and is producible with ease at low cost.

According to the present invention, there is a core holding device for rotatably holding a core on which a label strip is wound. The holding device includes a core holding member equipped with a plurality of flexible fingers for removably holding the core so that the core and the core holding member rotate together. These fingers are arranged around a common circle and are angularly spaced from each other. There is a mounting bracket having a circular recess for removably receiving and pivotally mounting the core holding member. The facing surfaces of the core holding member and the circular recess of the mounting bracket act as two brake surfaces which contact frictionally for imparting a predetermined braking force against the rotation of the core holding member.

A core and label winding looseness preventing bracket is spaced from the mounting bracket. At least one of these two brackets is pivotable relative to the other between a first position, where it is angularly spaced from the other to provide easy access into the space between the brackets for servicing and replacing a core, and a second position, where it is in registration with the other bracket to prevent the label strip from coming loose from the core.

DESCRIPTION OF THE PREFERRED EMBODIMENT

A preferred embodiment of the present invention will now be described with reference to the accompanying drawings.

Figure 1:
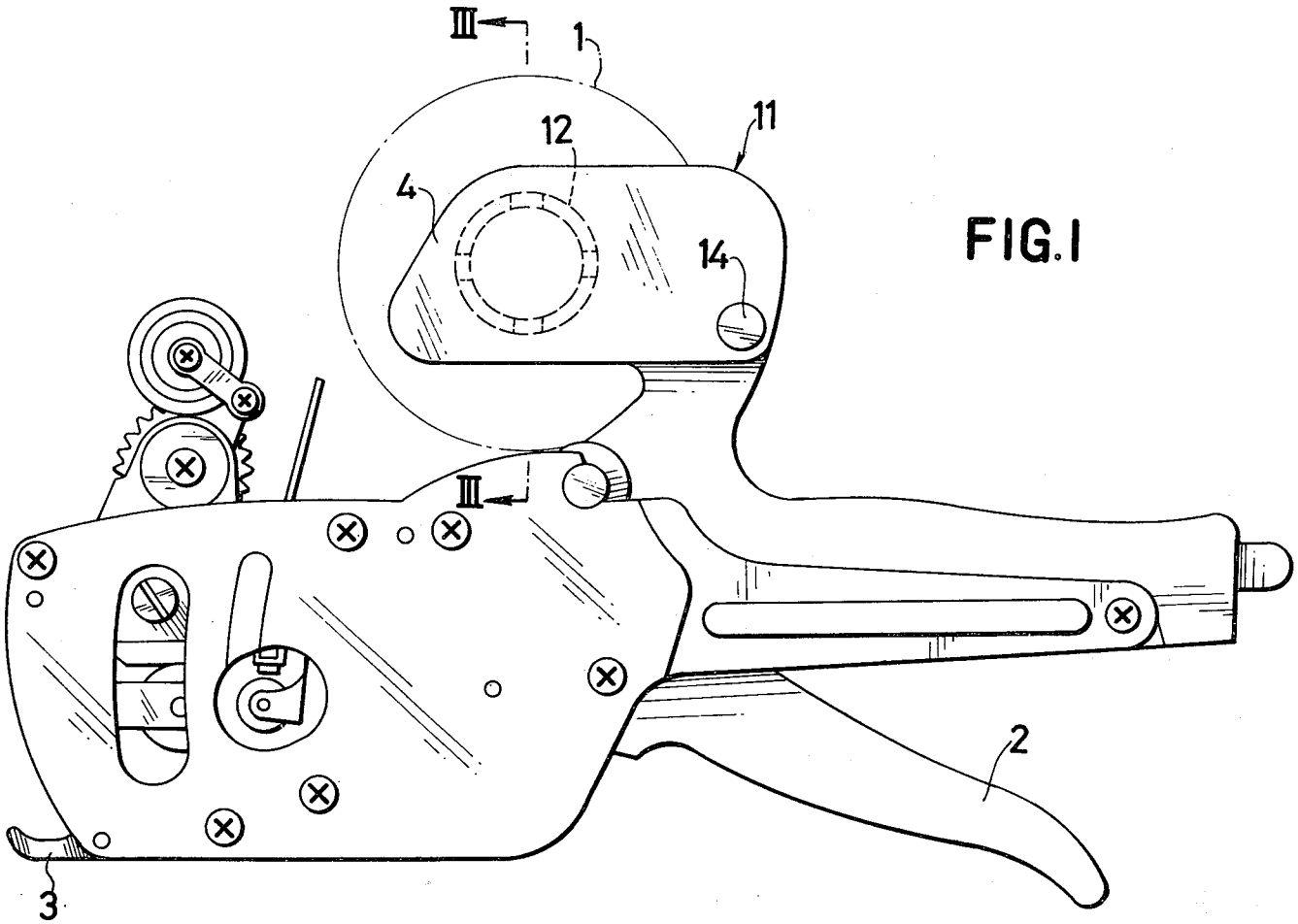
FIG. 1 is a side elevational view showing a label printing and applying apparatus equipped with a core holding device according to the present invention.

FIG. 1 shows a label printing and applying apparatus, which is equipped with a holding device 11 for holding a rolled label strip. The label strip 1 is in the form of a roll wound upon a core 12 which is held by the holding device 11. The label strip is fed, by the alternate gripping and releasing operations of a hand lever 2, from core 12 to a labeling member 3 located at the lower left-hand corner of the apparatus. An example of such a feeding apparatus can be found in the U.S. Pat. No. Re.27,889.

Figure 2:
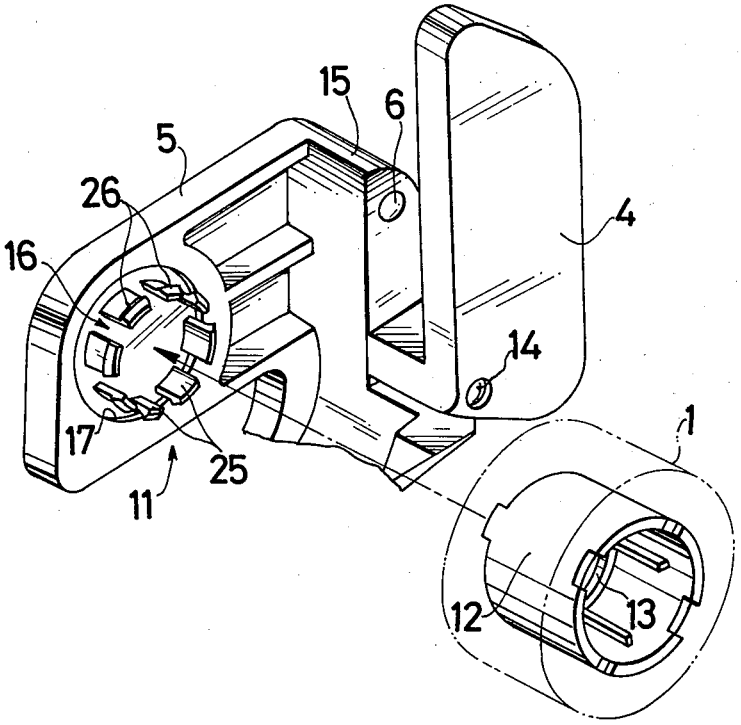
FIG. 2 is a perspective view showing an essential portion of the core holding device.
Figure 3:
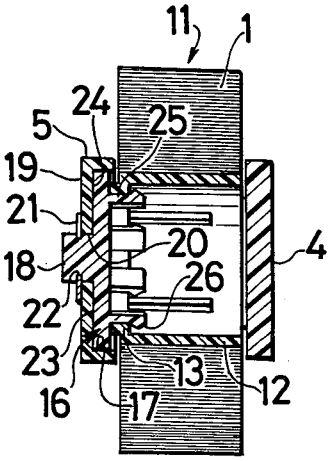
FIG. 3 is a cross-sectional view taken along line III—III of FIG. 1.

In FIGS. 2 and 3, the label strip holding device 11 generally includes a label and core looseness preventing bracket 4, a mounting bracket 5 and a core holding member 16 which is rotatably mounted on the mounting bracket 5. The two brackets 4 and 5 are supported in spaced apart and juxtaposed positions and they are preferably shaped symmetrically. Brackets 4 and 5 are made of a synthetic resin. They are joined at their common rear connecting portion 15. The looseness preventing bracket 4 is mounted on a pivot 14, which extends into a base portion of the mounting bracket 5. Bracket 4 has an angle of rotation of at least about 90° about the pivot 14, as shown in FIG. 2. This pivotal construction is necessary to provide easy access into the space between the two brackets 4 and 5 when the holding device 11 has the core 12 loaded on it or when the core holding member 16 is removed from the holding device. A locking projection 6, extending from the side surface of the one portion of connecting portion 15 to which bracket 5 is connected, snaps into a cooperating recess (not shown) in the portion of connecting portion 15 to which bracket 4 is connected. This retains the looseness preventing bracket 4 in registration with the mounting bracket 5 when the former is pulled down so that both have the relative position shown in FIG. 1. The purpose of the looseness preventing bracket 4 is to prevent the rolled label strip 1 from coming loose or falling or sliding or unwinding off the side of the core 12 when the label printing and applying apparatus is turned or tilted sideways during its use.

Figure 4:
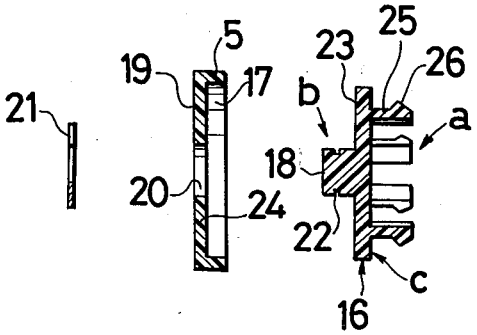
FIG. 4 is an exploded view showing a portion of FIG. 3.

The mounting bracket 5 is integral with and is stationary relative to the body of the label printing and applying apparatus. In an inner side wall of the mounting bracket 5, at the vicinity of its open end, there is formed a circular recess 17 in which a disc shaped core holding member 16 is rotatably fitted. One side of the core holding member 16 is formed into a retained section *b*, by which the member 16 is pivotally retained in the mounting bracket 5. The retained section *b* comprises a short shaft 18 which is formed with an annular groove 22 on its circumference, as seen in FIGS. 3 and 4. The shaft 18 is inserted through a mounting bore 20, which is formed in an outer wall 19 at the back of the circular recess 17. The shaft 18 and its groove 22 extends through the bore 20 to the outside of the mounting bracket 5 and the shaft is retained at its annular groove 22 by a retaining snap ring 21. The annular groove 22 is located as near to the base of the shaft 18 as the thickness of bracket 5 would permit such that an exterior brake surface 23 of the core holding member 16 is in frictional contact with a corresponding brake surface 24 on the bottom wall of the circular recess 17. A proper braking force due to the frictional contact between the two surfaces 23 and 24 is exerted upon the core holding member 16. The core holding member 16 is prevented from freely rotating as a result of any external rotational force in either direction that may be imparted thereto during the operation of the label printing and applying apparatus.

The other side of the core holding member 16 is formed into a holding section *a*, which removably holds the core 12. This holding section *a* may be integrally made of a flexible synthetic resin. It is composed of a plurality of flexible, resilient fingers 25. The fingers 25 extend from a disc shaped section *c* radially inwardly from the edge of section *a*. The fingers are arranged on a common circle and are angularly spaced around the section *a*. The effective outside diameter of the flexible fingers 25, which is also the diameter of the common circle which the fingers are in, is made slightly larger than the internal diameter of the bore 13 of the core 12. The flexible fingers 25 all have at their respective outer open ends, radially outwardly extending projections 26 which can be removably snap-fitted past the entry peripheral wall (FIG. 3) in the bore 13 of core 12, thereby to hold the core 12 in position. The core 12 for the label strip 1 can be turned around the short shaft 18 against a braking frictional force. The core is rotated by motion of the label strip 1 which is established in accordance with the gripping and releasing operation of the hand lever 2. Thus, the label strip 1 can be fed under such a proper tension that it may be free from any slackness.

In the embodiment described, moreover, the core holding member 16 is mounted on the stationary mounting bracket 5. Alternatively, the holding member 16 may also be mounted on the pivotable bracket 4 in a similar manner.

As is apparent from the foregoing description, attachment and removal of the core 1 for the label strip 1 can be accomplished in a simplified fashion. It should also be appreciated that the label strip 1 can be prevented from becoming slack or loose. Since the holding device according to the present invention can have a remarkably simplified construction and can be produced with ease, it is possible to materially reduce the production cost of the label printing and applying apparatus as a whole, as compared with prior apparatus.

As many widely different embodiments of the present invention can be made without departing from the spirit and scope thereof, it is to be understood that the invention should not be limited to the specific embodiments thereof except as defined in the appended claims.

What is claimed is:

1. A holding device for rotatably holding a core on which a label strip is wound, said device comprising:

a core holding member for removably receiving and for securely holding said core such that said core and said holding member rotate together;

a mounting bracket to which said core holding member is mounted and with respect to which it is rotatable;

braking means interposed between said mounting bracket and said core holding member for imparting a predetermined braking force to the rotation of said core holding member, whereby the label strip can be prevented from getting slack while it is being fed;

a label strip looseness preventing bracket for preventing the label strip from coming loose from said core; means for connecting said brackets to be relatively pivotable with respect to each other between a first position, where they are angularly spaced from each other to provide easy access into the space between them, and a second position where they are in angular registration; said looseness preventing bracket being shaped so as to extend past said core holding member when said brackets are in their said second position; said looseness preventing bracket being spaced from said mounting bracket a distance such that with a core mounted to said core holding member and said brackets being in said second position, said looseness preventing bracket passes near to and beyond the end of the core as it extends past the core.

2. A holding device according to claim 1, wherein said mounting bracket has an inner side wall facing toward said looseness preventing bracket and has an opposite outer side wall; said inner side wall being provided with a circular recess having a bottom wall therein; a concentric through bore extending from said bottom wall of said recess completely through said mounting bracket and its said outer side wall;

said core holding member including a disc section sized to be rotatably fitted in and rotatable in said circular recess; said disc section including a retained section having a shaft extending concentrically from said disc section in said recess and through said through bore to the outside of said mounting bracket at the side thereof of said outer side wall; said shaft being formed with means for removably securing it and for removably drawing said disc section against said recess bottom wall for frictional braking between said disc section and said mounting bracket.

3. A holding device according to claim 2, further comprising a plurality of flexible, resilient fingers extending from said disc section out of said mounting bracket inner side wall and toward said looseness preventing bracket and being arranged on a circle on said disc section and being angularly spaced from each other; said flexible fingers being positioned such that the effective outside diameter of their said circular arrangement is slightly larger than that of the inner bore of a core; said fingers having outer free ends away from said disc section and said fingers being formed at their respective said free ends with radially extending projections which are sized to be removably snap-fitted in the bore of the core thereby to hold the core in position.

4. In combination, a holding device according to claim 3 and a core to be held by the device;

said core having a generally cylindrical, tubular shape and having an inner bore therethrough; said core bore being defined by internal walls; said core bore having at least a portion of said walls thereof with an internal diameter less than said effective outside diameter of said circular arrangement of fingers and said fingers all being positioned in said core bore and each being in engagement with said core bore wall portion.

5. A holding device according to claim 3, wherein said core holding member is made integrally and of a flexible synthetic resin.

6. A holding device according to claim 2, wherein said means for securing said shaft comprises an annular groove around the circumference of said shaft and placed to be adjacent said mounting bracket outer side wall when said core holding member is pressed into said recess; and retaining means, including a snap ring sized to be fitted in said annular groove, thereby to retain said core holding member on said mounting bracket;

said core holding member being held by said means for securing said shaft so as to brake rotation of said core holding member.

7. A holding device according to claim 2, wherein said braking means includes a brake surface formed on said disc section of said core holding member to face toward said recess bottom wall and a corresponding brake surface formed on said recess bottom wall; said braking surfaces frictionally contacting for producing a predetermined braking force.

8. A holding device according to claim 1, wherein said first and second positions of said brackets are angularly spaced from each other at at least a right angle.

* * * * *